US010260217B2

(12) United States Patent
Enlow et al.

(10) Patent No.: US 10,260,217 B2
(45) Date of Patent: Apr. 16, 2019

(54) FAUCET WITH ARTICULATING ARM

(71) Applicant: DELTA FAUCET COMPANY, Indianapolis, IN (US)

(72) Inventors: Brian Alan Enlow, Noblesville, IN (US); Darrell Scott Crowe, Lebanon, IN (US); Kurt Judson Thomas, Indianapolis, IN (US); Seth Fritz, Carmel, IN (US); Celine Kwok Garland, Zionsville, IN (US)

(73) Assignee: Delta Faucet Company, Indianapolis ( * ) Notice: Subject to any disclaimer, the term of this patent is extended or adjusted under 35 U.S.C. 154(b) by 0 days.

(21) Appl. No.: 15/694,370

(22) Filed: Sep. 1, 2017

(65) Prior Publication Data

US 2017/0362803 A1 Dec. 21, 2017

Related U.S. Application Data

(63) Continuation of application No. 14/694,709, filed on Apr. 23, 2015, now Pat. No. 9,850,642.

(60) Provisional application No. 61/985,105, filed on Apr. 28, 2014.

(51) Int. Cl.
*E03C 1/04* (2006.01)

(52) U.S. Cl.
CPC .... *E03C 1/0404* (2013.01); *E03C 2001/0414* (2013.01); *E03C 2001/0415* (2013.01); *Y10T 137/9464* (2015.04)

(58) Field of Classification Search
USPC ..... 137/801
See application file for complete search history.

(56) References Cited

U.S. PATENT DOCUMENTS

| | | | |
|---|---|---|---|
| 192,728 | A | 7/1877 | Bailey |
| 1,714,232 | A | 5/1929 | Morris |
| 2,492,049 | A | 12/1949 | Krone et al. |
| 3,726,318 | A | 4/1973 | Hyde |
| 5,185,893 | A | 2/1993 | Lin |
| 5,492,148 | A | 2/1996 | Goughneour et al. |
| 6,446,278 | B1 | 9/2002 | Lin |
| 6,820,291 | B1 | 11/2004 | Weaver |
| D527,796 | S | 9/2006 | Lammel |
| D534,990 | S | 1/2007 | Zhou |
| 7,197,776 | B2 | 4/2007 | Tsai |
| D585,110 | S | 1/2009 | Paini |
| D620,557 | S | 7/2010 | Eilmus |
| 8,061,386 | B2 | 11/2011 | Mueller et al. |
| D651,284 | S | 12/2011 | Flowers et al. |
| 8,070,076 | B2 | 12/2011 | Erickson et al. |
| 8,407,828 | B2 | 4/2013 | Vogel et al. |
| D685,881 | S | 7/2013 | Fritz |
| 8,621,681 | B2 | 1/2014 | Macan et al. |
| 8,869,821 | B2 | 10/2014 | Laera |
| 9,435,107 | B2 | 9/2016 | Rexach et al. |
| 9,568,132 | B2 | 2/2017 | Erickson et al. |
| 2006/0180222 | A1 | 8/2006 | Kang |
| 2007/0251590 | A1 | 11/2007 | Weinstein |
| 2008/0083844 | A1 | 4/2008 | Leber |
| 2008/0272203 | A1 | 11/2008 | Leber |
| 2013/0019974 | A1 | 1/2013 | Laera |
| 2014/0015246 | A1 | 1/2014 | Erickson et al. |
| 2014/0116553 | A1 | 5/2014 | Schoolcraft et al. |

*Primary Examiner* — John K Fristoe, Jr.
*Assistant Examiner* — Daphne M Barry
(74) *Attorney, Agent, or Firm* — Faegre Baker Daniels LLP

(57) ABSTRACT

A faucet includes a sprayhead removably supported by a positioning arm. The positioning arm is articulated to provide multiple degrees of freedom.

21 Claims, 6 Drawing Sheets

31
30
22
38
40
26
51B
56
61
58
56
54
55
54
56
42
60
58
44
48
56
54
67
58
61
60
62
50B
52
65
60
56
57
32
51B
56
60
59A
50A
44
46
61
63
61
56
58
24
28
51A
58
56
54
33
33
56
59B
42
36
54
56
60
34
51A
61
16

20
18
37

FAUCET WITH ARTICULATING ARM

CROSS-REFERENCE TO RELATED APPLICATION

This application is a continuation application of U.S. patent application Ser. No. 14/694,709, filed Apr. 23, 2015, which claims priority to U.S. Provisional Patent Application Ser. No. 61/985,105, filed Apr. 28, 2014, the disclosure of which is expressly incorporated herein by reference.

BACKGROUND AND SUMMARY OF THE DISCLOSURE

The present invention relates generally to faucets, and more particularly, to a faucet including a sprayhead removably supported by an articulated positioning arm.

Pull-down faucets have become a popular kitchen faucet configuration, allowing the user to efficiently dispense water to a desired location within the sink area. However, pull-down spout architecture is typically rigid and requires the user to either retract the pull-down sprayer or let it dangle from the end of the spout tube. Consequently, the user typically does not have flexibility to position and suspend the sprayer to a desired sink location.

An alternative solution for the standard pull-down faucet spout is the "commercial style" or "spring style" kitchen faucet. These faucets embody much more maneuverability for the sprayer and hose across the sink, however the corresponding docking arm lacks the ability to allow the user to position and control the sprayer around the kitchen sink. Additionally, these faucets are typically too large for most residential in-home use due to their need for a large spring support around the hose or waterway.

In one illustrative embodiment of the present disclosure, a faucet includes a base having an interior and defining a longitudinal axis, a sprayer assembly including a fluid outlet, and a waterway fluidly connecting a fluid source to the fluid outlet, the waterway at least partially passing through the interior of the base. A first arm is supported by the base, and a first pivot coupling defines a first pivot axis extending perpendicular to the longitudinal axis, the first arm being pivotable about the first pivot axis to selectively position the first arm relative to the base. A sprayer nest is supported by the first arm and is coupled to the sprayer assembly.

In one illustrative embodiment of the present disclosure, a support assembly for a faucet includes a waterway fluidly coupling a fluid source to a fluid outlet, and a base defining a longitudinal axis and configured to be secured to a surface, the waterway supported by the base. A first arm is pivotably coupled to the base, the first arm selectively positioning the fluid outlet relative to the base. A second arm is pivotably coupled to the base, the second arm selectively positioning the fluid outlet relative to the first arm. The waterway is external to the first arm and the second arm.

In one illustrative embodiment of the present disclosure, a method of selectively positioning a fluid outlet of a faucet is provided. The method includes providing a faucet, the faucet including a waterway fluidly connecting a base to a sprayer assembly, the base defining a longitudinal axis, releasably coupling the sprayer assembly to an articulated support structure, wherein the articulated support structure comprises a first arm pivotably coupled to the base; and pivoting the first arm about a first pivot axis extending perpendicular to the longitudinal axis and relative the base to position the sprayer assembly relative to the base.

In some embodiments of the present disclosure, an articulating arm supporting the faucet sprayer provides additional functionality in the sink area. The articular arm support provides a relatively low profile typical of a residential pull-down or pull-out faucet, flexibility of a free-moving sprayer hose, and ability to securely dock and position the sprayer for a precise task. For example, the user can extend the arm up or outward to help fill large pots. Alternatively, the user can lower the arm into sink to reduce water splash during clean up or filling the sink for dish washing. For ultimate freedom of movement, with the sprayer undocked, the articulating arm can be folded and rotated completely out of the way.

Additional features and advantages of the present invention will become apparent to those skilled in the art upon consideration of the following detailed description of the illustrative embodiment exemplifying the best mode of carrying out the invention as presently perceived.

BRIEF DESCRIPTION OF THE DRAWINGS

The detailed description of the drawings particularly refers to the accompanying figures in which.

DETAILED DESCRIPTION OF THE DRAWINGS

The embodiments of the invention described herein are not intended to be exhaustive or to limit the invention to precise forms disclosed. Rather, the embodiments selected for description have been chosen to enable one skilled in the art to practice the invention.

Figure 1:
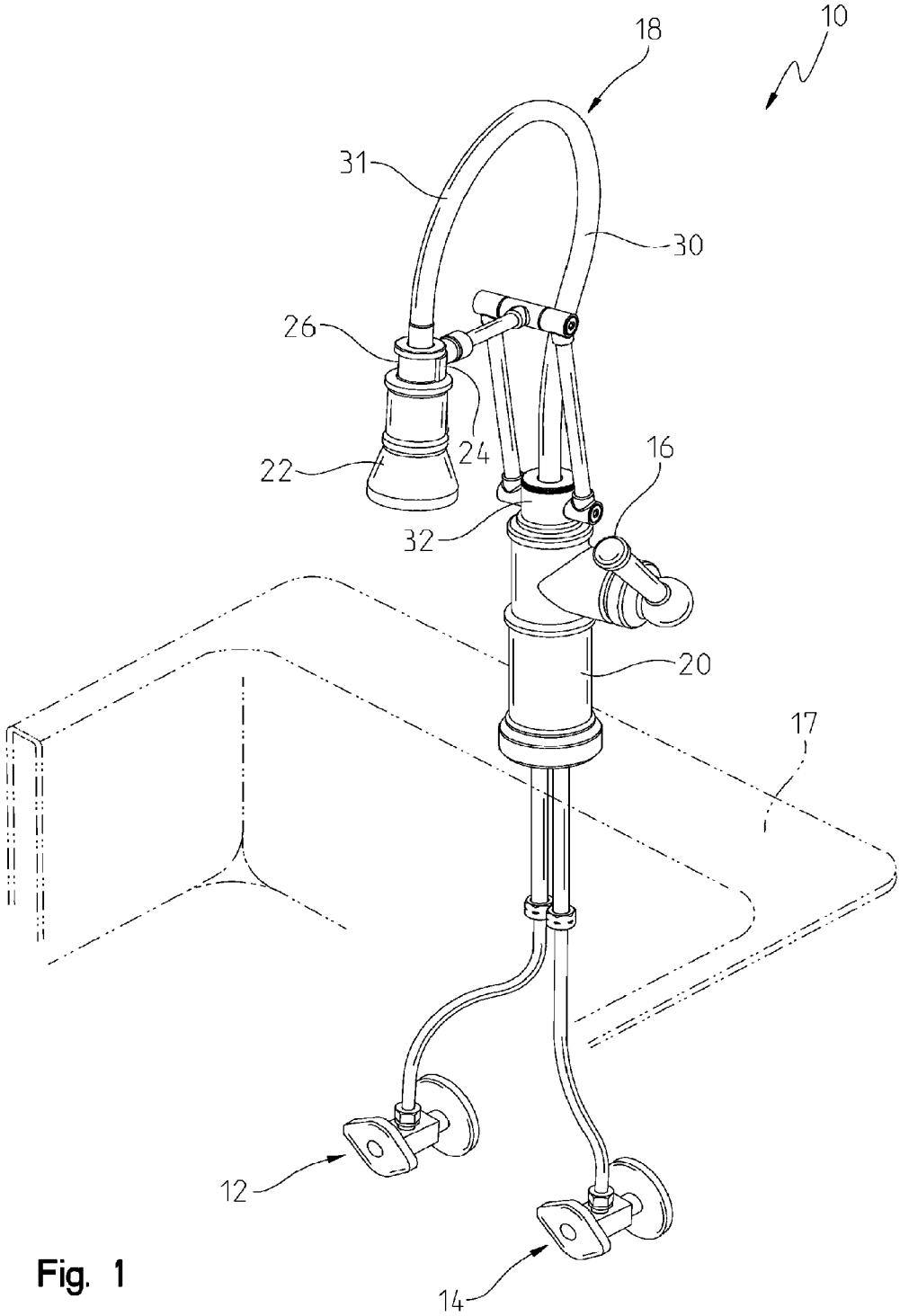
FIG. 1 is an elevated perspective view of an exemplary faucet of the present disclosure mounted on a sink basin.

As shown in FIG. 1, an illustrative faucet 10 is connected to a first fluid source 12 and a second fluid source 14. In an illustrative embodiment, first fluid source 12 is a cold water source (e.g., a conventional cold water stop valve) and second fluid source 14 is a hot water source (e.g., a conventional hot water stop valve). Faucet 10 illustratively includes a handle 16 connected to a conventional mixing valve 15 (FIG. 2) for mixing fluid from first and second fluid sources 12, 14. Faucet 10 is illustratively attached to a wash basin or sink deck 17, illustrated in phantom in FIG. 1.

Figure 2:
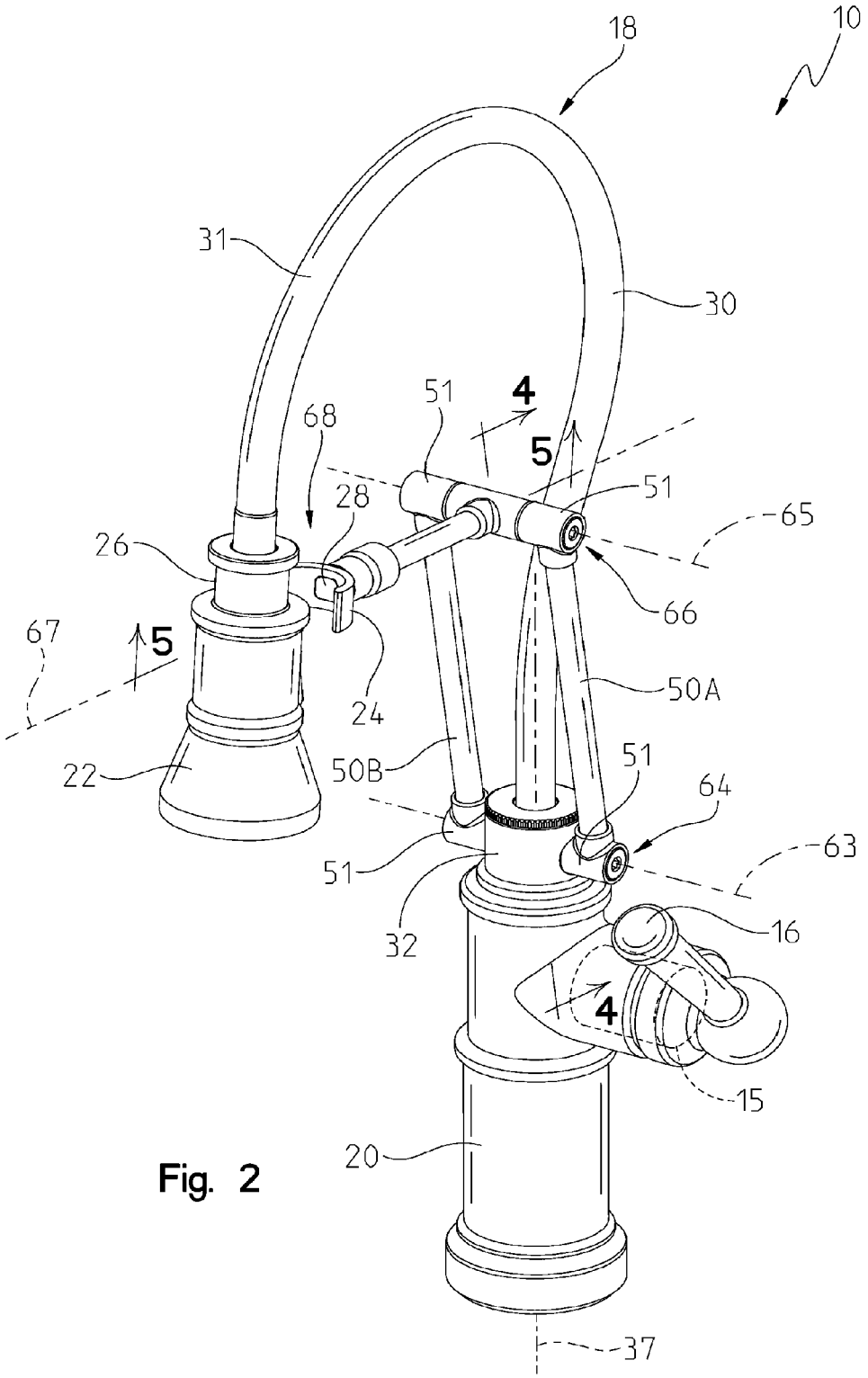
FIG. 2 is an elevated perspective view of the exemplary faucet of FIG. 1.
Figure 5:
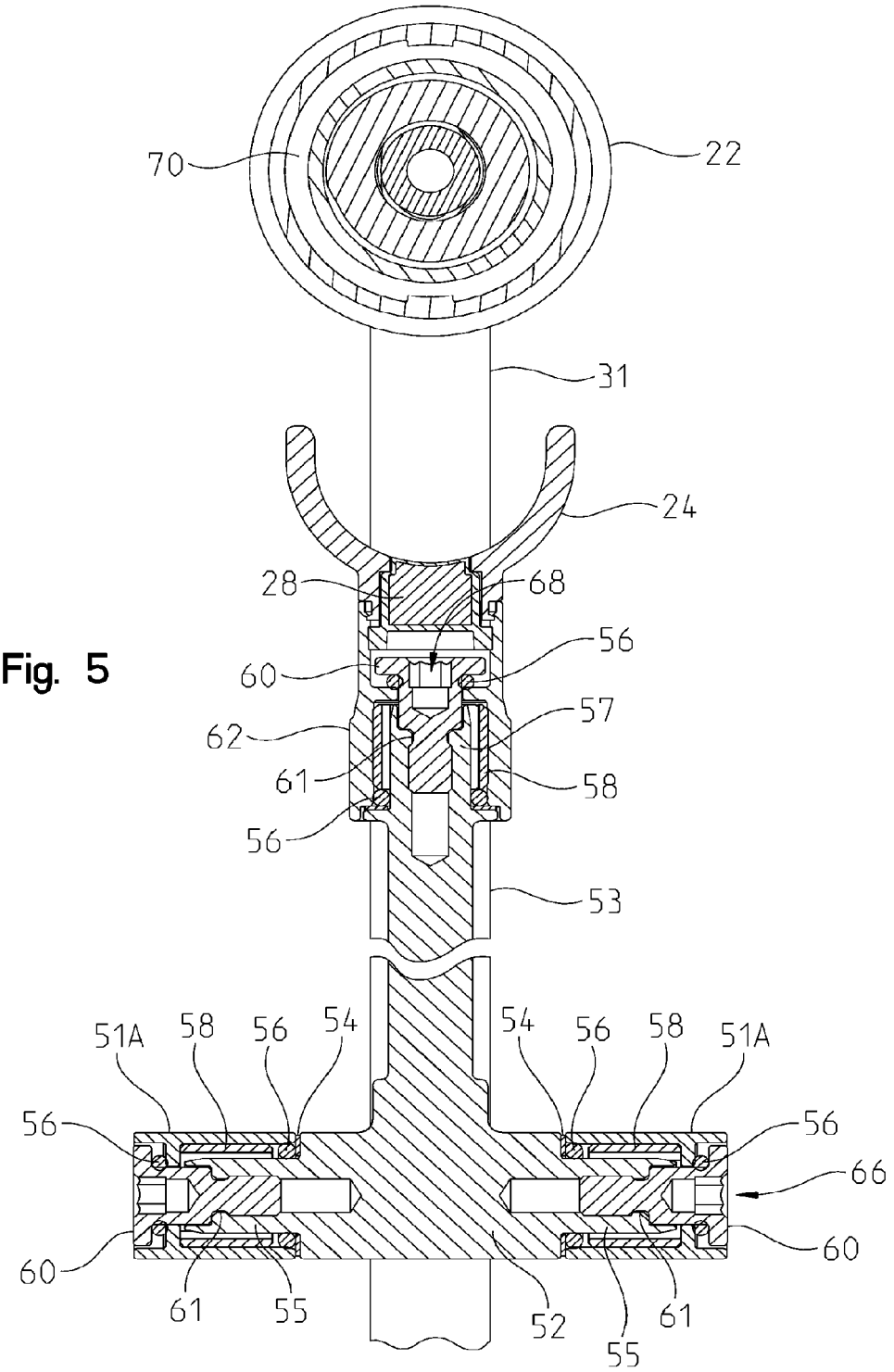
FIG. 5 is a cross-sectional view of the exemplary faucet of FIG. 2 taken along the line 5-5.

Referring next to FIGS. 1 and 2, faucet 10 includes a base 20 and a sprayer 22. Faucet 10 illustratively includes a waterway 18 fluidly connecting the first and second fluid sources 12, 14 to one or more fluid outlets 70 (see FIG. 5) defined by sprayer 22. Sprayer 22 is releasably coupled to base 20 by sprayer nest 24. In an illustrative embodiment, sprayer 22 includes a neck 26 sized to be received by sprayer nest 24. In one exemplary embodiment, sprayer nest 24 includes a magnet 28, and neck 26 is at least partially formed from a magnetically attractive material to releaseably couple sprayer 22 to sprayer nest 24. Waterway 18 illustratively extends through at least a portion of base 20 and hub 32. More particularly, the waterway 18 extends from the mixing valve 15 through an interior or passageway 29, defined by the base 20 and the hub 32, to the sprayer 22.

Figure 3:
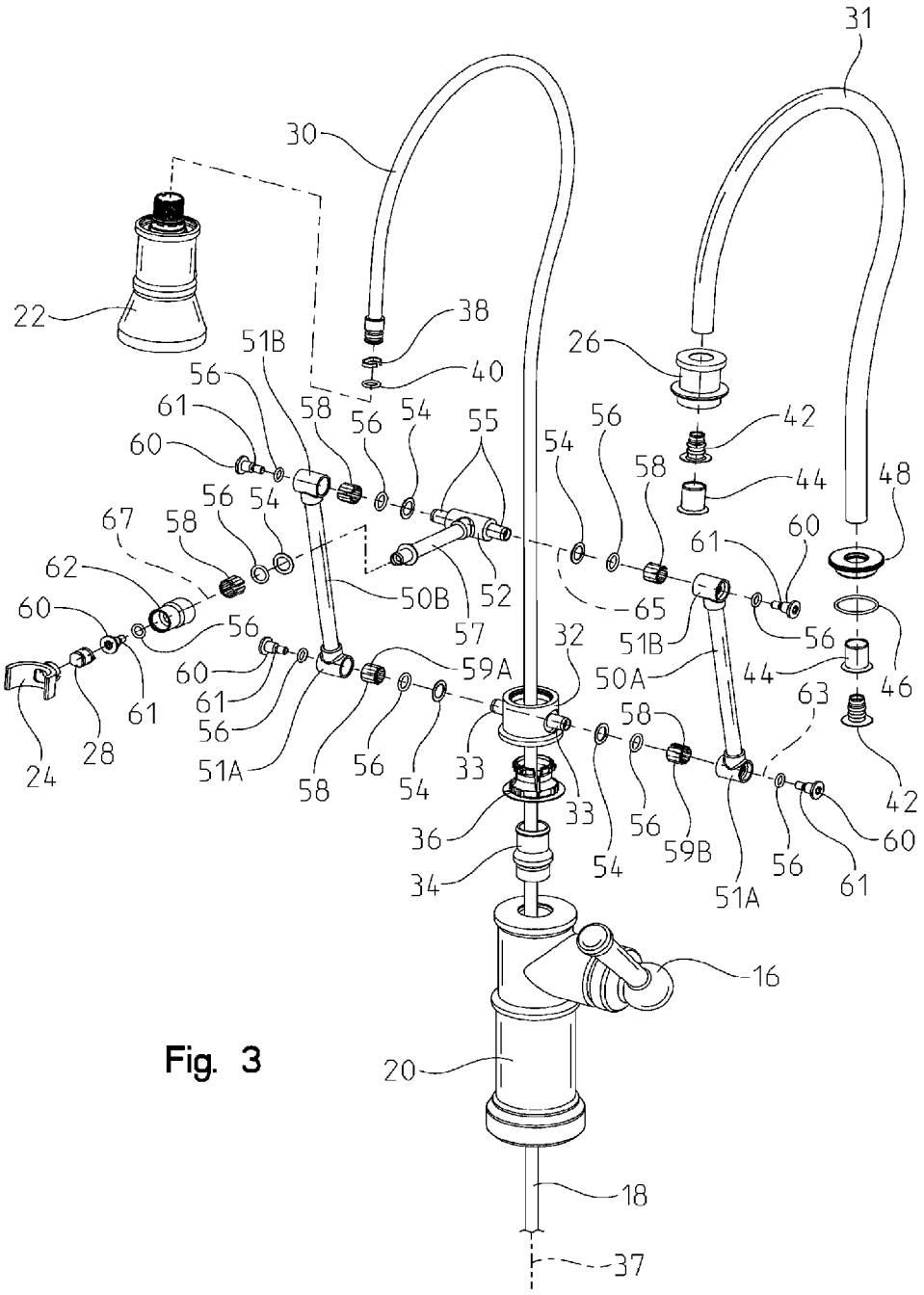
FIG. 3 is an exploded perspective view of the exemplary faucet of FIG. 2.

As illustrated in FIG. 2, at least a portion 30 of waterway 18 is flexible, allowing sprayer 22 to be positioned by a user at a plurality of positions relative to base 20. As illustrated in FIG. 3, the flexible portion 30 of waterway 18 may include a flexible sheathing 31 over the waterway 18. The waterway 18 is illustratively formed of a pre-formed polymeric material, such as cross-linked polyethylene (PEX), allowing the waterway to maintain the pre-formed shape and position the sprayer 22 above the sink deck 17 even when sprayer 22 is not coupled to sprayer nest 24. Sheathing 31 is illustratively formed of a flexible decorative material, such as rubber vinyl or braided nylon. Sheathing 31 may protect the waterway 18 and provide an aesthetically pleasing appearance. Sheathing 31 is illustratively attached to sprayer 22 using a snap ring 38 and an o-ring 40.

With further reference to FIG. 3, hub 32 is illustratively coupled to base 20 through an adaptor 34 and a ring base 36. Adaptor 34 and ring base 36 may permit rotation of hub 32 about longitudinal axis 37 relative to base 20. Hub 32 is illustratively coupled to sheathing 31 by barbed stopper 42, ferrule 44, o-ring 46, and retention nut 48. Base 20 and hub 32 extend upwardly around a longitudinal axis 37.

Figure 4:
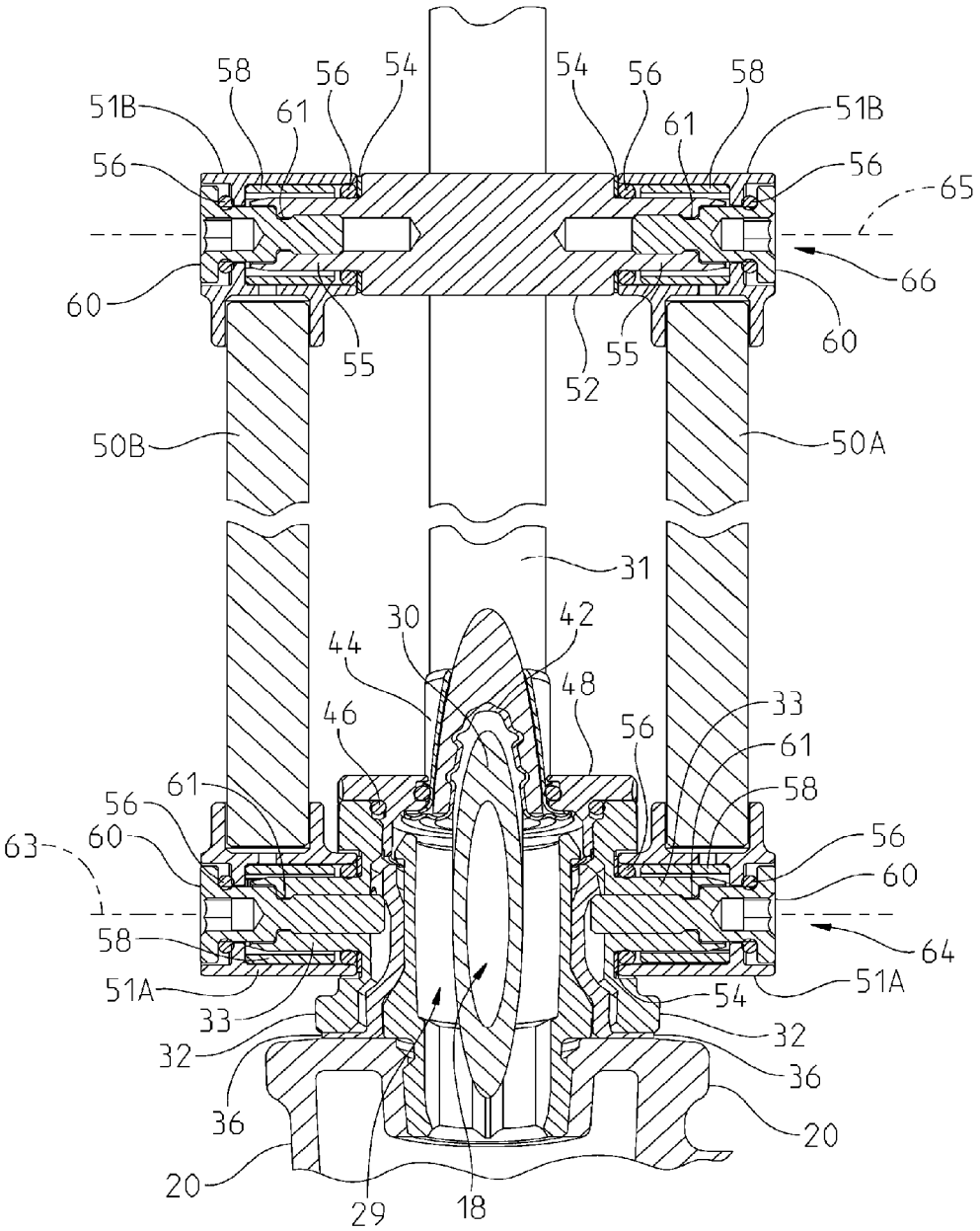
FIG. 4 is a cross-sectional view of the exemplary faucet of FIG. 2 taken along the line 4-4.
Figures 6, 7:
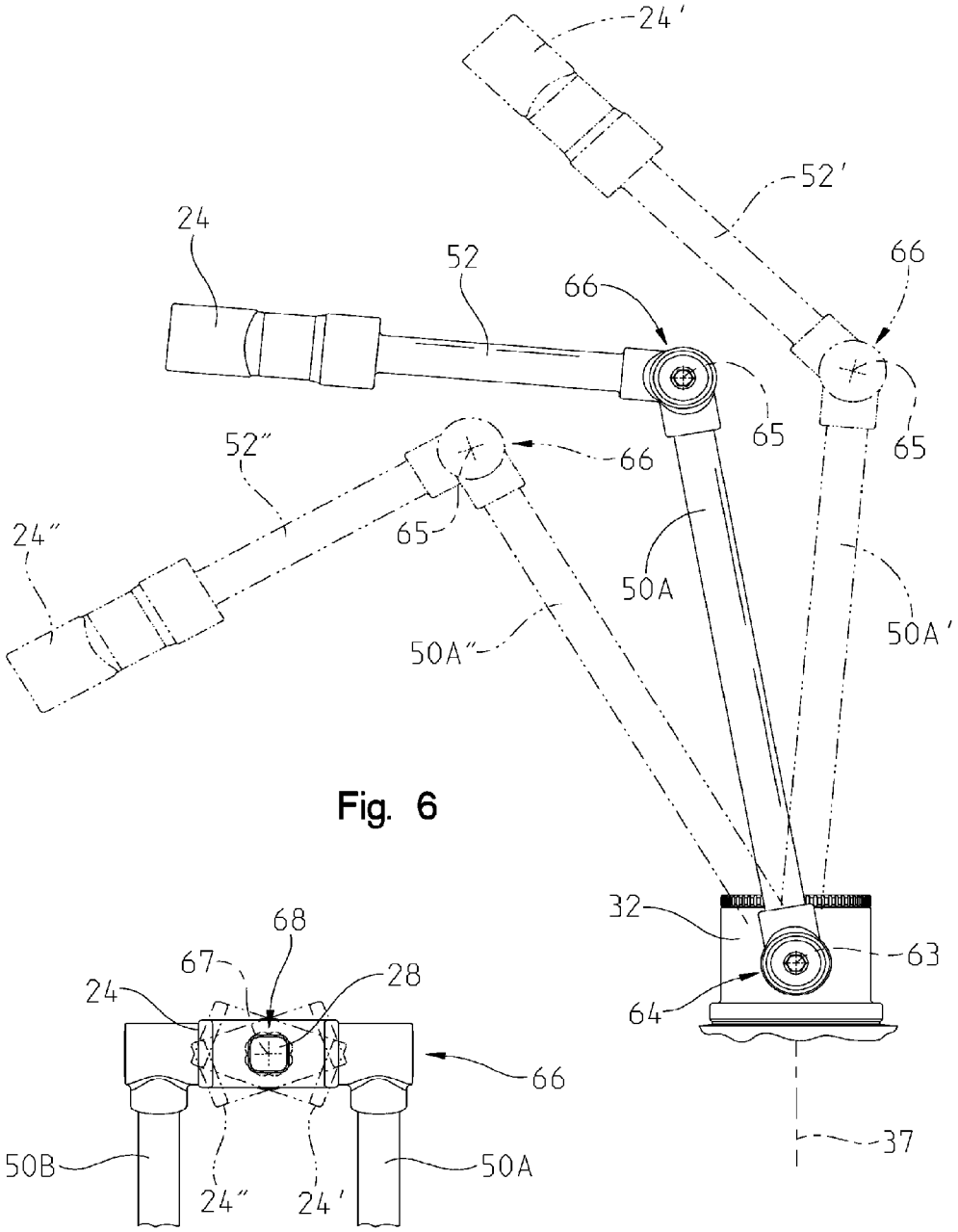
FIG. 6 is a side elevational view illustrating movement of the exemplary faucet of FIG. 2 about first and second pivot axes.
FIG. 7 is a front plan view illustrating movement of the exemplary faucet of FIG. 2 about a third pivot axis.

Referring next to FIGS. 3, 4, and 6, the relative position of sprayer 22 can be adjusted relative to the base 20 by pivoting the faucet 10 about a first pivot axis 63 defined by a first pivot coupling 64. The first pivot axis 63 extends transversely in a direction perpendicular to longitudinal axis 37. Adjustment about first pivot coupling 64 illustratively adjusts the height and angle of sprayer 22 (coupled to sprayer nest 24) relative to base 20.

More particularly, faucet 10 includes one or more articulating arms 50 pivotably coupled to hub 32. In the illustrated embodiment, faucet 10 includes a lower first arm 50A and a lower second arm 50B laterally spaced relative to lower first arm 50A. Opposing ends of each arm 50A, 50B illustratively includes an annular portion or cylindrical sleeve 51A, 51B. As illustrated in FIG. 3, the hub 32 includes one or more pins 33 extending from hub 32 along axis 63, about which the lower sleeve 51A of each arm 50A, 50B pivots.

A friction bushing 58 positioned between lower sleeve 51A and pin 33 maintains the position of the arm 50 about the first pivot axis 63. Friction bushing 58 illustratively includes a plurality of ridges 59A and troughs 59B to provide frictional engagement with an inner surface of the lower sleeve 51A. The weight of each arm 50 creates a compression force between the outer surface of the pin 33, ridges 59A and troughs 59B on the friction bushing 58, and the inner surface of the sleeve 51A. The friction bushing 58 resists movement of the arm 50 relative to the hub 32 due to friction forces between the ridges 59A and troughs 59B of the friction bushing 58 and the pin 33 of hub 32 and the sleeve 51A of arm 50. Typically, a force applied by a user to the arms 50 or sprayer 22 is sufficient to overcome this frictional force and allow arms 50 to pivot relative to base 20 about pivot axis 63. However, the frictional force is typically great enough that once the force applied by the user is removed, the weight of the sprayer 22 and arms 50 is insufficient to overcome the frictional force, such that arms 50 remain fixed in position relative to the base 20.

Arms 50 and hub 32 are illustratively coupled by screws 60 of first pivot coupling 64. Screw 60 illustratively includes a step 61 that controls the compression force between the sleeve 51A and the pin 33. A washer 54 is illustratively provided to act as a glide ring/wear washer. O-rings 56 are illustratively provided to seal the interior components from water or other contaminants.

Relative movement of the arm 50A and hub 32 about first pivot coupling 64 is illustrated in FIG. 6. Arm 50A is illustratively rotatable between at least a first position 50A' and a second position 50A". As shown in FIG. 6, the friction bushing 58 holds the relative position of arm 50A and hub 32 after a user has moved the arm 50A to a desired position. When arm 50A is moved to each position by a user, friction bushing 58 provides a friction with pin 33 and sleeve 51A of arm 50 large enough to maintain the position. Arm 50B illustratively moves with arm 50A, allowing for movement of sprayer 22 in relation to the base 20.

Referring further to FIGS. 3, 4, and 6, the relative position of sprayer 22 (coupled to sprayer nest 24) to base 20 can also be adjusted by pivoting the faucet 10 about a second pivot axis 65 defined by a second pivot coupling 66. The second pivot axis 65 extends transversely in a direction parallel to first pivot axis 63 and perpendicular to longitudinal axis 37. Faucet 10 illustratively includes an upper arm or forearm 52 connecting the one or more arms 50 to the sprayer 22. As shown in FIG. 3, the forearm 52 illustratively includes one or more pins 55 extending from the forearm 52, and about which the forearm 52 pivots relative to the arms 50.

Friction bushing 58 positioned between upper sleeve 51B of arm 50 and pin 55 of forearm 52 maintains the position of the arm 50 about the second pivot axis 65. Friction bushing 58 illustratively includes a plurality of ridges 59A and troughs 59B. The weight of the forearm 52 and sprayer 22 creates a compression force between the outer surface of the pin 55, ridges 59A and troughs 59B on the friction bushing 58, and the inner surface of the sleeve 51B. The friction bushing 58 resists movement of the forearm 52 relative to the arms 50 due to friction forces between the ridges 59A and troughs 59B of the friction bushing 58 and the pin 55 of forearm 52 and the sleeve 51B of arm 50. Typically, a force applied by a user to the forearm 52 or sprayer 22 is sufficient to overcome this frictional force and allow forearm 52 to pivot relative to arms 50 about pivot axis 65. However, the frictional force is typically great enough that once the force applied by the user is removed, the weight of the sprayer 22 and forearm 52 is insufficient to overcome the frictional force such that forearm 52 remains fixed in position. Clearance between the pin 33 and sleeve 51A about first pivot axis 63 is typically tighter or less than clearance between the pin 55 and sleeve 51B about second pivot axis 65. This results in a larger friction force about the first pivot coupling 64 compared to the second pivot coupling 66.

Arms 50 and forearm 52 are illustratively coupled by screws 60 of second pivot coupling 66. Screw 60 illustratively includes a step 61 that controls the compression force between the sleeve 51B and the pin 55. A washer 54 is illustratively provided to act as a glide ring/wear washer. O-rings 56 are illustratively provided to seal the interior components from water or other contaminants.

Relative movement of the arm 50A and the forearm 52 about second pivot axis 65 is also illustrated in FIG. 6. Forearm 52 is illustratively rotatable between at least a first position 52', and a second position 52". As shown in FIG. 6, the friction bushing 58 holds the relative position of arm 50A and forearm 52 after a user has moved the forearm 52 to a desired position. When forearm 52 is moved to each position by a user, friction bushing 58 provides a friction with pin 55 and sleeve 51B of arm 50 large enough to maintain the position of forearm 52 relative to arms 50.

Referring next to FIGS. 3, 4, and 7, the angle of sprayer 22 (coupled to sprayer nest 24) can be adjusted relative to the base 20 by pivoting the faucet 10 about a third pivot coupling 68. As illustrated in FIG. 3, the forearm 52 includes shaft or pin 57 extending from forearm 52, about which an annular portion or cylindrical sleeve 62 of nest 24 pivots. Friction bushing 58 between sleeve 62 and the pin 57 maintains the position of the nest 24 relative to forearm 52. Forearm 52 and sleeve 62 of nest 24 are illustratively coupled by screw 60. Screw 60 illustratively includes a step 61 that controls the compression force between the sleeve 62 and the pin 57. A washer 54 is provided to act as a glide ring/wear washer. O-rings 56 illustratively seal the interior components from water or other contaminants.

Relative movement of the nest 24 and the pin 57 about third pivot axis 67 is illustrated in FIG. 7. Nest 24 is illustratively rotatable between a clockwise position 24' and a counterclockwise position 24" relative to the forearm 52. As shown in FIG. 7, the friction bushing 58 holds the relative position of sprayer nest 24 and forearm 52 after a user has moved the sprayer nest 24 to the desired angle. When sprayer nest 24 is moved to each position about third pivot axis 67 by a user, friction bushing 58 provides friction with pin 57 and sleeve 62 of sprayer nest 24 large enough to maintain the relative position of sprayer nest 24 relative to forearm 52.

Although the invention has been described in detail with reference to certain preferred embodiments, variations and modifications exist within the spirit and scope of the invention described and defined in the following claims.

The invention claimed is:

1. A faucet comprising:
- a base defining a longitudinal axis;
- a sprayer assembly including a fluid outlet;
- a waterway fluidly coupled to the fluid outlet;
- a first arm supported by the base, the waterway being at least partially positioned outside of the first arm;
- a first pivot coupling defining a first pivot axis extending perpendicular to the longitudinal axis, the first arm pivotable about the first pivot axis to selectively position the first arm relative to the base;
- a sprayer nest supported by the first arm, the sprayer assembly releasably coupled to the sprayer nest; and
- wherein the waterway is positioned in spaced relation to, and extends above, the first pivot axis, when the sprayer assembly is coupled to the sprayer nest.

2. The faucet of claim 1, wherein the base is configured to be coupled to a sink deck.

3. The faucet of claim 1, further comprising:
- a second arm supported by the first arm, the waterway being at least partially positioned outside of the second arm; and
- a second pivot coupling defining a second pivot axis extending parallel to the first pivot axis, the second arm pivotable about the second pivot axis to selectively position the second arm relative to the first arm, the waterway positioned in spaced relation to, and extending above, the second pivot axis.

4. The faucet of claim 1, further comprising a third pivot coupling defining a third pivot axis extending perpendicular to the first pivot axis and the second pivot axis, the sprayer nest rotatable about the third pivot axis to selectively position the sprayer nest relative to the second arm.

5. The faucet of claim 1, wherein the first pivot coupling includes a friction bearing positioned between the first arm and the base, the friction bearing including a plurality of ridges and troughs contacting the arm and the base, wherein the friction bearing maintains the position of the first arm relative to the base.

6. The faucet of claim 5, wherein the first pivot coupling further includes a screw including a step controlling a compression force on the friction bearing.

7. The faucet of claim 1, wherein at least one of the sprayer assembly and the sprayer nest includes a magnet and the other of the sprayer assembly and the sprayer nest includes a magnetically attractive element, wherein the magnet removably coupling the sprayer assembly to the sprayer nest.

8. The faucet of claim 1, wherein the first arm is rotatable about the longitudinal axis.

9. The faucet of claim 8, further comprising a hub supported by the base for rotation about the longitudinal axis, the first pivot coupling supported by the hub.

10. A faucet comprising:
- a base defining a longitudinal axis;
- a sprayer assembly including a fluid outlet;
- a waterway fluidly coupled to the fluid outlet;
- a first arm supported by the base;
- a first pivot coupling defining a first pivot axis extending perpendicular to the longitudinal axis, the first arm pivotable about the first pivot axis to selectively position the first arm relative to the base;
- a second arm supported by the first arm;
- a sprayer nest supported by the second arm and coupled to the sprayer assembly;
- a second pivot coupling defining a second pivot axis extending parallel to the first pivot axis, the second arm pivotable about the second pivot axis to selectively position the second arm relative to the first arm; and
- wherein the waterway extends between a first end operably coupled to the base and a second end operably coupled to the sprayer assembly with at least a portion of the waterway positioned above the first pivot axis and the second pivot axis.

11. The faucet of claim 10, further comprising a third pivot coupling defining a third pivot axis extending perpendicular to the first pivot axis and the second pivot axis, the sprayer nest rotatable about the third pivot axis to selectively position the sprayer nest relative to the second arm.

12. The faucet of claim 10, wherein:
- the first pivot coupling includes a friction bearing positioned between the first arm and the base, wherein the friction bearing of the first pivot coupling maintains the position of the first arm relative to the base; and
- the second pivot coupling includes a friction bearing positioned between the second arm and the first arm, wherein the friction bearing of the second pivot coupling maintains the position of the second arm relative to the first arm.

13. The faucet of claim 12, wherein each of the first pivot coupling and the second pivot coupling further includes a screw including a step controlling a compression force on the friction bearing.

14. The faucet of claim 12, wherein the friction applied by the first pivot coupling is greater than the friction applied by the second pivot coupling.

15. The faucet of claim 10, wherein the sprayer assembly is removably coupled to the sprayer nest.

16. The faucet of claim 15, wherein at least one of the sprayer assembly and the sprayer nest includes a magnet and the other of the sprayer assembly and the sprayer nest includes a magnetically attractive element, wherein the magnet removably coupling the sprayer assembly to the sprayer nest.

17. The faucet of claim 10, wherein the first arm is rotatable about the longitudinal axis.

18. The faucet of claim 17, further comprising a hub supported by the base for rotation about the longitudinal axis, the first pivot coupling supported by the hub.

19. A faucet comprising:

a flexible waterway;

a water dispenser fluidly coupled to the flexible waterway;

a support assembly configured to support the water dispenser, the support assembly supported for rotation about a vertically extending longitudinal axis, the support assembly including a first arm supported for pivoting movement about a first pivot axis extending perpendicular to the longitudinal axis, and a second arm supported for pivoting movement about a second pivot axis extending parallel to the first pivot axis, wherein the flexible waterway is at least partially positioned outside of the first arm and the second arm; and a nest supported by the second arm of the support assembly, the water dispenser releasably coupled to the nest, wherein a portion of the flexible waterway extends above the second pivot axis when the water dispenser is coupled to the nest.

20. The faucet of claim 19, wherein the support assembly further defines a third pivot axis extending perpendicular to the first pivot axis and the second pivot axis, the nest being rotatable about the third pivot axis to selectively position the nest relative to the second arm.

21. The faucet of claim 19, further comprising a base, and a hub supported by the base for rotation about the longitudinal axis, the first arm being coupled to the hub.

* * * * *